US010077635B2

(12) United States Patent
Xu et al.

(10) Patent No.: US 10,077,635 B2
(45) **Date of Patent: *Sep. 18, 2018**

(54) DEBRIS CATCHER

(71) Applicant: BAKER HUGHES INCORPORATED, Houston, TX (US)

(72) Inventors: Zhiyue Xu, Cypress, TX (US); Jason M. Harper, Cypress, TX (US); James S. Sanchez, Tomball, TX (US); James G. King, Kingwood, TX (US); Edward O'Malley, Aberdeen (GB)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 62 days.

This patent is subject to a terminal disclaimer.

(21) Appl. No.: 14/961,475

(22) Filed: Dec. 7, 2015

(65) Prior Publication Data

US 2016/0333668 A1 Nov. 17, 2016

Related U.S. Application Data

(63) Continuation-in-part of application No. 14/713,645, filed on May 15, 2015.

(51) Int. Cl.
*E21B 37/00* (2006.01)
*E21B 27/00* (2006.01)

(52) U.S. Cl.
CPC ..... *E21B 37/00* (2013.01); *E21B 27/005* (2013.01)

(58) Field of Classification Search
CPC ..... E21B 37/00; E21B 27/00; E21B 27/005; E21B 43/08; E21B 43/082
See application file for complete search history.

(56) References Cited

U.S. PATENT DOCUMENTS 5,893,416 A * 4/1999 Read ..... E21B 37/06 166/228
6,920,930 B2 7/2005 Allamon et al.
7,610,957 B2 11/2009 Davis et al.
8,257,585 B2 9/2012 Davis et al.
8,783,365 B2 7/2014 McCoy et al.
8,800,660 B2 8/2014 Fishbeck et al.
(Continued)

OTHER PUBLICATIONS

PCT/US2016/030991—International Search Report and Written Opinion dated Aug. 12, 2016.

*Primary Examiner* — Zakiya W Bates
*Assistant Examiner* — Crystal J Miller
(74) *Attorney, Agent, or Firm* — Mossman, Kumar & Tyler, PC

(57) ABSTRACT

A debris catcher can include an anchor connected to the wellbore tubular and a filter fixed to the anchor. The filter is positioned in a bore of the wellbore tubular and has an disintegrable accelerator material located in a carrier body. The debris catcher formed at least partially of a disintegrable accelerator material located in a carrier body is conveyed in a wellbore tubular. The disintegrable accelerator material is exposed to a downhole material in a subterranean fluid flowing through the wellbore tubular. The debris catcher filters the downhole material. It is emphasized that this abstract is provided to comply with the rules requiring an abstract, which will allow a searcher or other reader to quickly ascertain the general subject matter of the technical disclosure.

17 Claims, 5 Drawing Sheets

(56) References Cited

U.S. PATENT DOCUMENTS

| | | | | |
|---|---|---|---|---|
| 8,844,850 | B2 | 9/2014 | He | |
| 2002/0043507 | A1 | 4/2002 | McCulloch | |
| 2002/0162655 | A1* | 11/2002 | Lynde | E21B 37/00 166/99 |
| 2006/0246833 | A1 | 11/2006 | Arnold, Jr. et al. | |
| 2008/0087433 | A1 | 4/2008 | Mashburn et al. | |
| 2010/0243258 | A1 | 9/2010 | Fishbeck et al. | |
| 2011/0024119 | A1 | 2/2011 | Wolf et al. | |
| 2012/0118571 | A1 | 5/2012 | Zhou | |
| 2013/0025849 | A1 | 1/2013 | Richard et al. | |
| 2013/0206393 | A1* | 8/2013 | Kuo | E21B 43/082 166/227 |
| 2014/0196912 | A1 | 7/2014 | Turley et al. | |
| 2014/0208842 | A1 | 7/2014 | Miller et al. | |
| 2014/0238123 | A1 | 8/2014 | Richards et al. | |

* cited by examiner

DEBRIS CATCHER

CROSS-REFERENCE TO RELATED APPLICATIONS

This application is a Continuation-in-Part of U.S. patent application Ser. No. 14/713,645 filed on May 15, 2015, the entire disclosure of which is incorporated herein by reference in its entirety.

BACKGROUND OF THE DISCLOSURE

1. Field of the Disclosure

This disclosure relates generally to oilfield downhole tools and more particularly to methods and devices for filtering subterranean fluids using a debris catcher.

2. Description of the Related Art

Wellbore operations such as drilling, wireline logging, completions, perforations and interventions are performed to produce oil and gas from underground reservoirs. Wellbores can extend thousands of feet underground to the underground reservoirs. Some of these operations leave materials in the wellbore. These downhole materials flow back to the surface and require filtering. In some aspects, the present disclosure is directed to methods and devices for filtering a well using a debris catcher that is degradable.

SUMMARY OF THE DISCLOSURE

In one aspect, the present disclosure provides a debris catcher for performing a downhole operation in a wellbore tubular. The debris catcher may include an anchor connected to the wellbore tubular. The debris catcher may also have a filter fixed to the anchor and positioned in a bore of the wellbore tubular. The filter may comprise a disintegrable accelerator material located in a carrier body.

In another aspect, the present disclosure provides a method for performing a downhole operation in a wellbore tubular. The method may include conveying a debris catcher formed at least partially of a disintegrable accelerator material located in a carrier body and exposing the disintegrable accelerator material to a downhole material in a subterranean fluid flowing through the wellbore tubular. The method may also include initiating a functionally intended chemical reaction between the disintegrable accelerator material and the downhole material, degrading the downhole material, and filtering the downhole material using the debris catcher.

Illustrative examples of some features of the disclosure thus have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

The present disclosure relates to devices and methods for filtering downhole tool materials using a debris catcher. The debris catcher is installed into the production string below the wellhead or as part of the wellhead assembly. The debris catcher catches particles and pieces in the subterranean fluid, for example, degradable downhole materials that flow back during production. The debris catcher prevents the downhole materials from damaging any wellbore components, such as valves. Also, the debris catcher degrades and can be removed from the flowbore. Illustrative debris catchers are described below.

Figure 1:
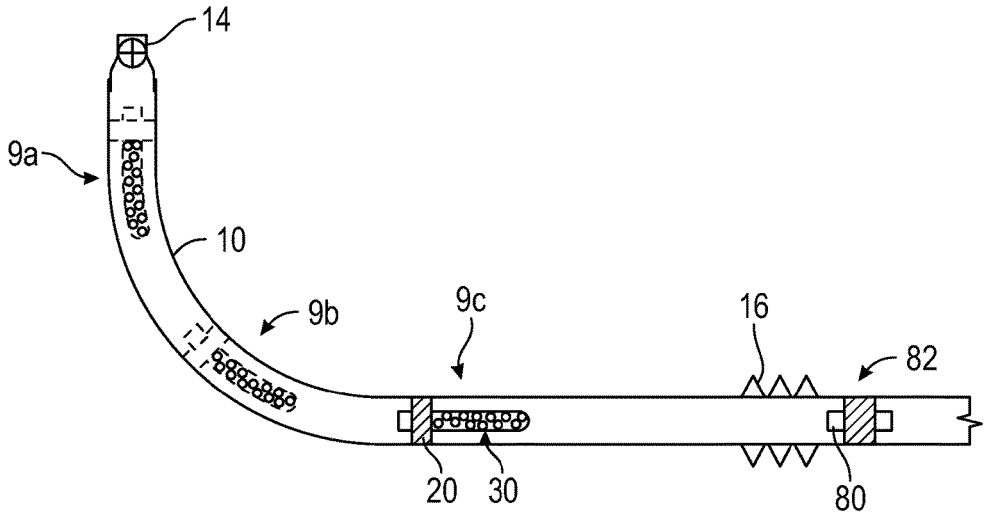
FIG. 1 shows an exemplary debris catcher at different locations along a wellbore tubular according to the present disclosure.

FIG. 1 shows one non-limiting embodiment of the debris catcher 9 for filtering downhole materials 80 entrained in downhole fluids flowing towards the surface equipment. The debris catcher 9 may be run in conjunction with other bottom hole assemblies inside a wellbore tubular 10 such as a casing, liner, tubing or other suitable tubular. A conveyance device (not shown) is used to deploy and retrieve the debris catcher 9 into the wellbore tubular 10. The debris catcher 9 may be set at different locations along the wellbore including the vertical section 9*a*, curved section 9*b*, and/or horizontal section 9*c*. Or, the debris catcher 9 may be located at the wellhead or Christmas tree 14 portion of the wellbore tubular 10. The downhole material 80 may be fragments or portions of a frac plug, frac balls, slips of a completion or production tool 82, etc. In some instances, the downhole material 80 may be a degradable material.

In some embodiments, the well tool 9 may include an anchor 20 affixed to a filter 30. The anchor 20 is configured to set the filter 30 with respect to the wellbore tubular 10. The anchor 20 may include slips, a packer or a nipple profile that snaps into a profile. As discussed in greater detail below, some or all of the filter 30 may be formed of a degradable material.

Figure 2:
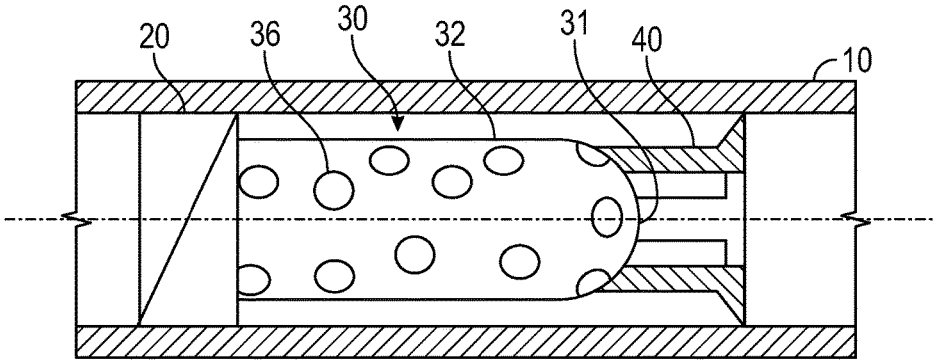
FIG. 2 shows an exemplary debris catcher with perforations and a shock absorber according to the present disclosure.

FIG. 2 shows an exemplary filter 30 that filters unwanted particles from downhole fluids, such as fluid produced from a subterranean formation. The filter 30 can have a housing 32 that may be formed of a degradable material and includes flowpaths such as perforations 36. The housing 32 can have a cylindrical form in the shape of a hollow basket, and a nose 31 pointing towards a downhole direction, which would be into the fluid flowing to the surface. The wellhead 14 end of the wellbore tubular 10 is the uphole side of the wellbore and the opposite end of the wellbore tubular 10 is the downhole side of the wellbore. The axial length of the filter 30 may change depending on the size and amount of the downhole material 80, subterranean fluids, degradation time limits, and perforation design.

The perforations 36 may have a pattern, shape, and/or size that depend on the nature of the debris to be filtered from the fluid. The perforations 36 or other channels 38 may be sized to selectively admit only certain particles to pass through to the surface. For example, their size may be large enough to allow the passage of some harmless material to the well equipment and to allow enough fluid flow to the surface. However, large debris or other undesirable particles in the downhole fluid, which are larger than a predetermined size, are prevented from passing through the perforations 36. For example, the flowpaths are sufficiently small to reduce the likelihood that the particles will impact or get caught in a valve along the wellbore, or corrode or otherwise damage the wellbore. Regarding shape, perforations 36 may be circular, oval, slots, or slits, for instance. In addition, the perforations 36 may be in a wrapped-screen or other screen form.

In some embodiments, the perforation 36 are open prior to and during deployment. In other embodiments, the perforations 36 can be open or filled with a degradable material prior to deployment.

Herein, "degradable" means disintegrable, corrodible, decomposable, soluble, or at least partially formed of a material that can undergo an irreversible change in its structure. Examples of suitable materials and their methods of manufacture are given in United States Patent Publications No. 2013/0025849 (Richard and Doane) and 2014/0208842 (Miller et al.), and U.S. Pat. No. 8,783,365 (McCoy and Solfronk), which Patent Publications and Patents are hereby incorporated by reference in their entirety. A structural degradation may be a change in phase, dimension or shape, density, material composition, volume, mass, etc. The degradation may also be a change in a material property; e.g., rigidity, porosity, permeability, etc. Also, the degradation occurs over an engineered time interval; i.e., a predetermined time interval that is not incidental. Illustrative time intervals include minutes (e.g., 5 to 55 minutes), hours (1 to 23 hours), or days (2 to 3 or more days). Also, the degradation happens at a specific time based on environmental and structural inputs, which may be human initiated and controlled. For the purposes of this disclosure, biodegradable materials are not considered degradable because such materials rely on uncontrolled interaction with microorganisms.

The degradable material can be high-strength and lightweight, and have sintered powder compacts formed from coated powder materials that include various lightweight particle cores and core materials having various single layer and multilayer nanoscale coatings. These powder compacts are made from coated metallic powders that include various electrochemically-active (e.g., having relatively higher standard oxidation potentials) lightweight, high-strength particle cores and core materials, such as electrochemically active metals, that are dispersed within a cellular nanomatrix formed from the various nanoscale metallic coating layers of metallic coating materials, and are particularly useful in borehole applications.

Suitable core materials include electrochemically active metals having a standard oxidation potential greater than or equal to that of Zn, including as Mg, Al, Mn or Zn or alloys or combinations thereof. For example, tertiary Mg—Al—X alloys may include, by weight, up to about 85% Mg, up to about 15% Al and up to about 5% X, where X is another material. In one embodiment, the material has a substantially uniform average thickness between dispersed particles of about 50 nanometers (nm) to about 5000 nm. In one embodiment, the coating layers are formed from Al, Ni, W or Al2O3, or combinations thereof. In one embodiment, the coating is a multi-layer coating, for example, comprising a first Al layer, a Al2O3 layer and a second Al layer. In some embodiments, the coating may have a thickness of about 25 nm to about 2500 nm. In addition, surface irregularities to increase a surface area of the filter 30, such as grooves, corrugations, depressions, etc. may be used.

As noted above, the degradation is initiated by exposing the degradable material to a stimulus. In embodiments, the filter 30 degrades in response to exposure to a fluid. Illustrative fluids include engineered fluids (e.g., frac fluid, acidizing fluid, acid, brine, water, drilling mud, etc.) and naturally occurring fluids (e.g., hydrocarbon oil, produced water, etc.). The fluid used for stimulus may be one or more liquids, one or more gases, or mixtures thereof. In other embodiments, the stimulus may be thermal energy from surrounding formation. Thus, the stimulus may be engineered and/or naturally occurring in the well or wellbore tubular 10 and formation.

The filter 30 may also include phenolics, polyvinyl alcohols, polyacrylamide, polyacrylic acids, rare earth elements, glasses (e.g. hollow glass microspheres), carbon, elastic material, or a combination of these materials or above sintered powder compact material. Elastic material herein includes elastomers and means that the filter 30 can flex.

In one method of operation, the conveyance device is used to deploy the debris catcher 9 at a specific target depth along the wellbore tubular 10. After fracturing is completed, the conveyance device pulls the well string up the wellbore. The debris catcher 9 is deployed and set at depth via the conveyance device. The anchor 20 is set. The well is allowed to flow up and produce subterranean fluids. The degradable material in the filter 30 degrades and opens the perforations 36 to flow. The filter 30 filters the subterranean fluid through the perforations 36. The downhole material 80 that cannot pass the filter 30 accumulates outside the housing 32 and degrades until it can pass through the perforations 36. After the process complete the debris catcher 9 may be retrieved.

The debris catcher 9 may be connected to the conveyance device through any suitable means. The conveyance device may be tubing, coiled tubing, drillpipe, wireline, slickline, electric line or a combination thereof. The conveyance device may also set the anchor 20.

It should be appreciated that the debris catcher 9 of the present disclosure is subject to various embodiments. In a non-limiting embodiment of the present disclosure, the perforations 36 may have any shape including various concave and convex shapes.

Figure 3:
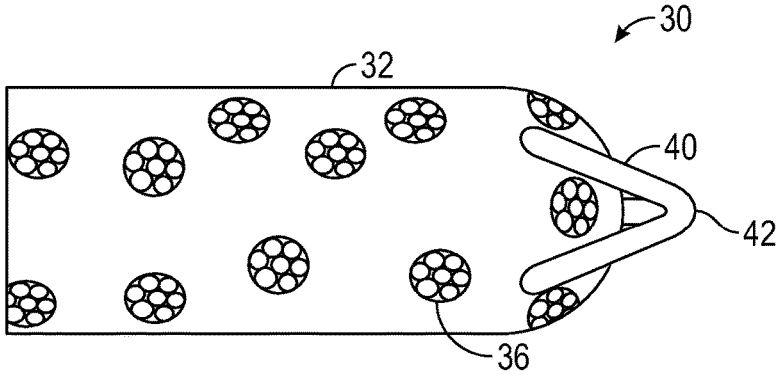
FIGS. 3 and 3A show side and end views, respectively, of an exemplary filter with perforations and a slicing member according to the present disclosure.
Figure 3A:
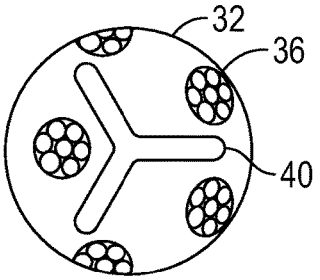

Another non-limiting embodiment of the present disclosure is shown in FIGS. 3 and 3A. The filter 30 may have beads in the perforations 36. The beads may have a uniform composition and/or size, or may be varied. For instance, the beads may have spherical or honeycomb shapes, or combinations of these. Also, some of the beads may include varying- and/or uniform-sized degradable material, and/or steel or other non-degradable alloys or composites.

Figure 4A:
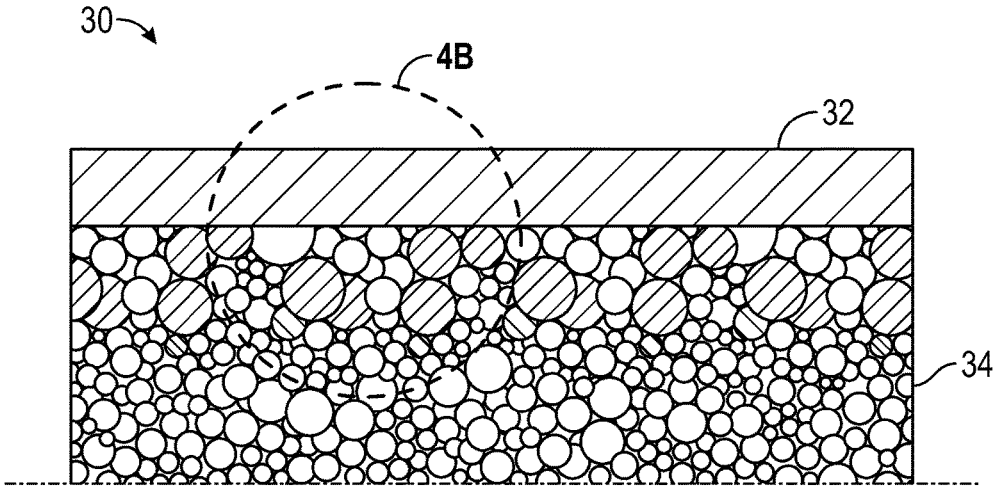
FIGS. 4A-C show detailed views of exemplary filters with a core with beads according to the present disclosure.
Figure 4B:
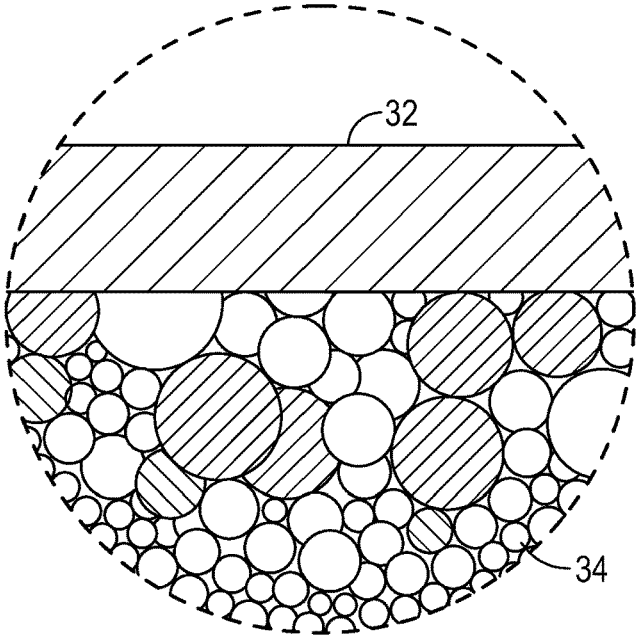
Figure 4C:
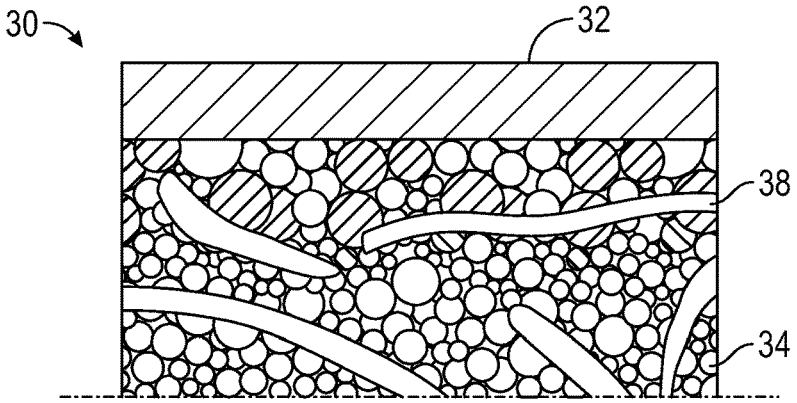

Another non-limiting embodiment of the filter 30 using the degradable beads is described in reference to FIGS. 4A-C. The filter 30 may have a housing 32 and a core 34 that is positioned inside the housing 32 as shown in FIG. 4A. The housing 32 may be composed of a non-degradable material such as steel or other metal alloys, or composites. The beads made of the degradable material form the core 34. The beads may have different compositions and/or sizes, as shown in detailed FIG. 4B, to degrade at different times or with respect to different stimuli. Also, the core 34 may have non-degradable beads. Alternatively, FIG. 4C shows the core 34 after the degradation process. Channels 38 may be formed in the core 34. The channels 38 may filter the downhole material 80.

Figure 5:
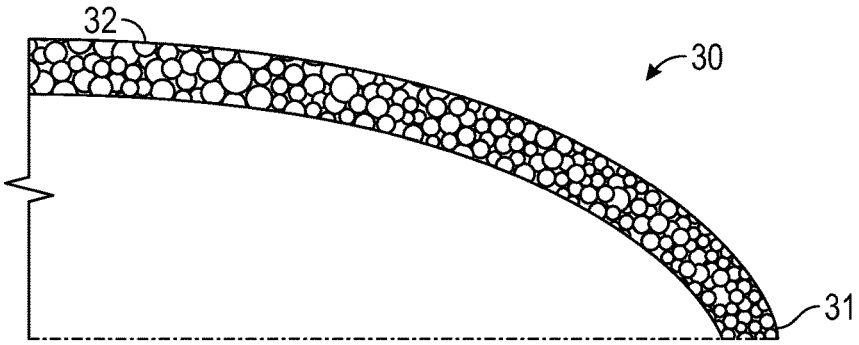
FIG. 5 shows an exemplary conical tapered filter according to the present disclosure.

In another embodiment, as referenced in FIG. 5, the filter 30 may have a conical shape or a shape with a hyperbolical cross-section. The nose 31 may face the downhole side. Alternatively, the filter 30 may be positioned as the nose 31 facing uphole. The housing 32 may have beads in uniform composition and geometry, or a medley as shown in detail in FIG. 4B.

In one non-limiting embodiment, the filter 30 may include a combination of structures and geometries as mentioned above and in FIGS. 2-5. For example, a downhole side of the filter 30 may have perforations 36 filled with the solid degradable material, and an uphole side of the filter 30 may have the housing 32 and the core 34 of beads.

In another embodiment, the debris catcher 9 may include a shock absorber 40 as shown in FIG. 2. The shock absorber 40 protects the debris catcher 9 from large pieces of downhole material 80 or downhole material 80 hitting at high speeds. The shock absorber 40 may have a collet-style-shape, or spring members. The shock absorber 40 may also have a slicing capability as shown in FIGS. 3 and 3A. An edge 42 of the shock absorber 40 with the slicing capability is sharp to separate the downhole material 80 into two or more pieces when the downhole material 80 is flowed toward uphole by the fluid. The shock absorber 40 of FIG. 3 can also work as a spring member, slowing down the downhole material 80 before the downhole material 80 hits the filter 30.

In another embodiment, multiple debris catchers 9 may be set at different depths, and each debris catcher 9 may have a different filtering capability. For instance, each filter 30 of the debris catcher 9 may degrade at different times, or may have different sized perforations 36 or filter 30 geometry, pattern, structure or composition. Some of the debris catchers 9 may have shock absorbers 40 with or without slicing capabilities. Therefore, downhole members 80 may be filtered at different filters 30 depending on the size and composition of the downhole member 80.

In a non-limiting method of operation, where the perforations 36 are already open, the filtering may begin once the anchor 20 is set.

As described above, the debris catcher 9 may be set at a single location and be degraded completely. Alternatively, a portion of the degradable material may be degraded at a first location; the debris catcher 9 may be set at a different location, and the filtering process may be repeated at that location. Or, different portions of the debris catcher 9 may be degraded at each location.

In another embodiment and method of operation, after a certain passage of time or based on a certain stimulus, the filter 30 of the debris catcher 9 may totally degrade. For example, the operator may pump fluid downhole to accelerate the degradation of the filter 30.

The debris catcher 9 according to the present disclosure can be used after various well treatment operations. The well treatment operations include well cleaning, hydraulic fracturing, acidizing, cementing, plugging, pin point tracer injection or other well stimulation or intervention operations. Stimulation operation is an operation that changes the characteristic of the formation or the fluid inside the formation.

Figure 6:
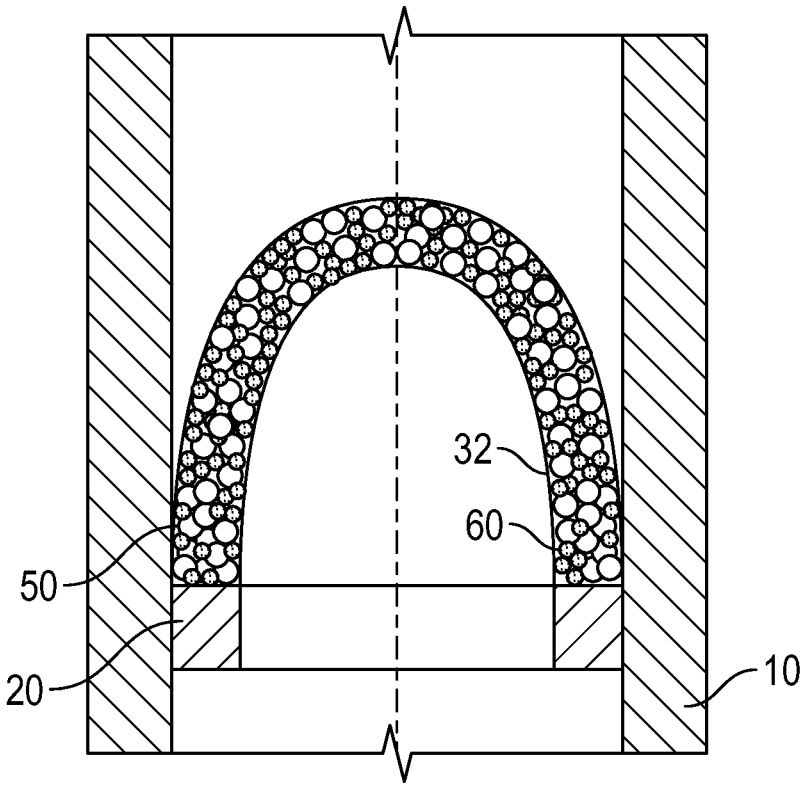
FIG. 6 shows an exemplary debris catcher with particles according to the present disclosure.
Figure 7A:
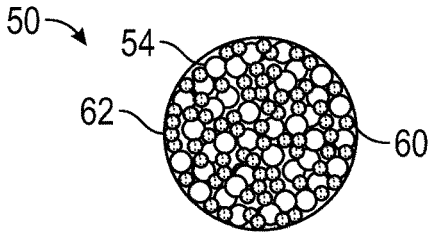
FIGS. 7A-C show exemplary particle constructions according to the present disclosure.
Figure 7B:
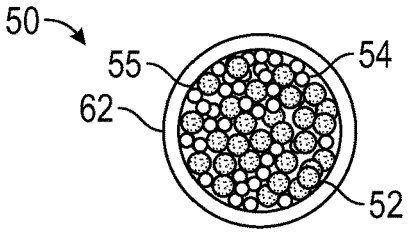
Figure 7C:
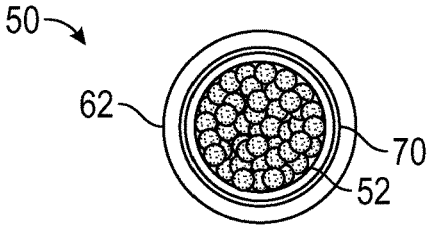
Figure 8:
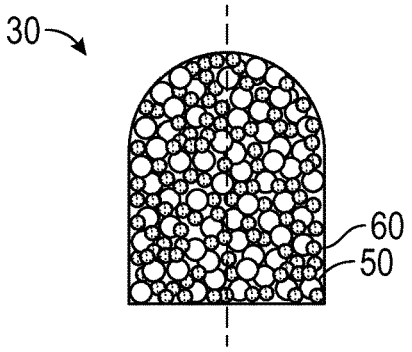
FIG. 8 shows an exemplary filter with a core filled with particles according to the present disclosure.

Another non-limiting embodiment of the present disclosure is shown in FIGS. 6-8. FIG. 6 shows the debris catcher 9 located in a wellbore tubular 10 for filtering downhole materials 80. The anchor 20 is set to secure the filter 30 with respect to the wellbore tubular 10. The debris catcher 9 has particles 50 that disintegrate or accelerate the degradation of the downhole materials 80. As will be discussed in greater detail below, the particles 50 may be released at a desired time and thereby allowed to act on the downhole materials 80. This interaction increases the efficiency and speed at which the downhole materials 80 are broken up and retrieved to the surface. The particles 50 may be spread through a filter base material 60. The particles 50 may be granules, a powder, pellets, beads, or other particulates that are interspersed and captured within the filter base material 60. Filter base material 60 is durable and robust, and bear wear of abrasion. Examples of filter base material 60 include materials like steel, other metals or other metal alloys used commonly in downhole tools.

As shown in detail in FIGS. 7A-C, the particles 50 have a disintegrable accelerator material 55 and a carrier body 62. The disintegrable accelerator can only be decomposed chemically. In contrast, the carrier body 62 is degradable mechanically, thermally or chemically. Thus, the accelerator material 55 and the carrier body 62 can be destabilized sequentially and independently. The particles 50 may also have the filter base material 60 mixed with disintegrable accelerator material 55 inside the carrier body 62. The carrier body 62 is a spherical enclosure that surrounds the accelerator material 55. The accelerator material 55 can be spherical.

As used throughout, the term "disintegrable" means that some predetermined manner of chemical interaction will cause the structure to decompose or otherwise lose structural integrity. Thus, a "disintegrable" structure can be intentional broken up by applying a predetermined chemical stimulus. A "disintegrable" material is not formulated or configured to structurally destabilize in a pre-determined manner by a non-chemical stimulus. In contrast, a "degradable" structure is a structure that can be decomposed or structurally destabilized by a pre-determined stimulus that is mechanical, thermal, and/or chemical.

In one embodiment, as in FIG. 7A, the disintegrable accelerator material 55 can be an electrode potential material 54, 52 that forms a high chemical potential differential between the electrode potential material and the downhole member 80. Examples of the accelerator materials 55 are copper and tin. Accelerator materials 55 are mixed, pressed and embedded into a matrix. The particle 50 may have the accelerator material 55 in uniform composition and geometry, or medley as shown. The disintegrable accelerator material 55 is provided in an amount and/or a concentration sufficient to break up the downhole material that is expected to be encountered.

The carrier body 62 can be degradable. Examples of the carrier body 62 can be copper or tin. Also, the carrier body 62 can be made into a very thin shell that is easily breakable by an impact force. The manufacturing methods of the carrier body 62 can be coating, or wrapping the carrier body 62 around the accelerator material 55.

One purpose of the carrier body 62 is to protect the disintegrable accelerator material 55 from outside effects. Another purpose of the carrier body 62 is to protect the filter base material 60 from reaction with the accelerator material 55. Yet, another purpose of the carrier body 62 is to delay the release of the accelerator material 55. First, the carrier body 62 can start degrading or is broken by the mechanical impact force the downhole material 80 applies. Since the carrier body 62 is compromised, the accelerator material 55 is exposed to the surroundings. The time it takes to break the carrier body 62 or disintegrate the accelerator material 55 can be engineered by the composition, structure or amount of materials therein.

FIG. 7B shows a different structure and composition of the particle 50. In this embodiment, the disintegrable accelerator material 55 can be of fluids and/or solids. Examples of the accelerator materials 55 are brines and hydrochloric acid. The carrier body 62 can be composed of ceramics, nitrides, or a corrosion resistant alloy.

FIG. 7C shows an energetic material 70 located in or next to the carrier body 62. The energetic material 70 stores a high amount of energy and responds to a trigger. The energetic material 70 releases that high energy and consumes some or all of the carrier body 62. Energetic materials or pyrotechnic materials, are usually homogenized mixtures of small particles of reducing agents and oxidizing agents that produce an effect of heat, light, sound, gas/smoke or a combination of these as a result of non-detonative self-sustaining exothermic chemical reaction. Choices for a reducing agent include aluminum, magnesium, calcium, titanium, zinc, silicon, boron, and combinations including at least one of the foregoing, while choices for an oxidizing agent include boron oxide, silicon oxide, chromium oxide, manganese oxide, iron oxide, copper oxide, lead oxide and combinations including at least one of the foregoing. Yet, for an additional embodiment, binders are used to turn the powder mixture into a solid material. Examples of binders include resins such as polyethylene, polyvinyl chloride, etc. Other examples of the energetic materials 70 include thermite, nano-foil and/or nano-aluminum. Thermite is a mixture of metal powder fuel and metal oxide, such as aluminum powder and iron oxide ($Fe_2O_3$). The energetic material 70 may also respond to a trigger, such as an electrical mechanism, a magnetic field mechanism, a microwave mechanism, a high-energy beam mechanism, and/or a radio frequency mechanism.

The carrier body 62 can be in a circular or honeycomb shape or, fibers, irregular particles, and/or any other shape. Similarly, the disintegrable accelerator material 55 can be made of a circular shape, or fibers, irregular particles, or any other shape.

The particles 50 can be located inside the perforations 36 of the filter 30. In one embodiment, the particles 50 are located in the housing 32 as shown in FIG. 5, or in the core 34 as seen in a cross-section of the filter 30 in FIG. 8. Also, the filter 30 may have a uniform composition of particles 50 or a medley of particles 50 with different compositions.

In one method of operation, the debris catcher 9 with the particles 50 embedded in the filter 30 is deployed and secured into the wellbore. After a well operation is completed, the downhole material 80 travels uphole in the wellbore and reaches the debris catcher 9. The downhole material 80 comes into contact with the downhole side of the filter 30. The carrier bodies 62 degrade and the accelerator material 55 disintegrates. Some downhole materials 80 continue in the uphole direction penetrating further into the filter 30. In one embodiment, the rate of disintegration of the accelerator material 55 may change depending on which part of the filter 30 the downhole material 80 comes into contact. Also, other well fluids or subterranean fluids may initiate the degradation or disintegration process. The parts of debris catcher 9 degrade or disintegrate. The time and amount of the disintegration or degradation can be engineered to open the wellbore to other operations.

In the case where the debris catcher 9 has a basket shape, and its nose facing uphole, the downhole material 80 accumulates in the debris catcher 9. The downhole material 80 may contact the inner surface of the filter 30 and chemically react with that inner surface.

In another method of operation, the particles 50 may be delivered from surface after the debris catcher 9 is deployed in the wellbore. Yet, in another method of operation, the particles 50 may be pumped or delivered downhole into the filter 30 to replenish the degraded or disintegrated parts of the filter 30.

In another method of operation, a trigger such as an electrical wave, a magnetic wave, microwave, a high-energy beam, and/or a radio frequency can be sent downhole to activate the energetic material 70. Or, a trigger member located in the debris catcher 9 can be activated by the trigger and the trigger member may activate the energetic member 70.

The foregoing description is directed to particular embodiments of the present disclosure for the purpose of illustration and explanation. It will be apparent, however, to one skilled in the art that many modifications and changes to the embodiment set forth above or embodiments of different forms are possible without departing from the scope of the disclosure. It is intended that the following claims be interpreted to embrace all such modifications and changes.

We claim:

1. A debris catcher for performing a downhole operation in a wellbore tubular, comprising:

an anchor connected to the wellbore tubular; and a filter fixed to the anchor and positioned in a bore of the wellbore tubular, wherein the filter comprises a disintegrable accelerator material located in a carrier body, the disintegrable accelerator material being selected to disintegrate a material received in the filter.

2. The apparatus of claim 1, wherein the disintegrable accelerator material has at least one of: (i) copper, (ii) silver, (iii) tin, (iv) nickel, (v) the alloys thereof, (vi) acids, and (vii) brines.

3. The apparatus of claim 1, wherein the carrier body comprises a sealed capsule.

4. The apparatus of claim 1, wherein the sealed capsule has at least one of (i) a degradable material, and (ii) a frangible shell.

5. The apparatus of claim 1, wherein the filter comprises a plurality of carrier bodies each with a varying rate of disposition in response to different stimuli.

6. The apparatus of claim 1, wherein the filter comprises a plurality of carrier bodies each with a different composition of the disintegrable accelerator material.

7. The apparatus of claim 1, wherein the disintegrable accelerator material is configured to interact with a degradable downhole material.

8. The apparatus of claim 7, wherein the interaction is a chemical interaction when the disintegrable accelerator material and the degradable downhole material come into contact.

9. The apparatus of claim 1, wherein the filter comprises an energetic material located in the carrier body.

10. The apparatus of claim 9, wherein the energetic material comprises at least one of: (i) thermite, (ii) nano-foil, and (iii) nano-aluminum.

11. The apparatus of claim 9, wherein the energetic material comprises a trigger response member comprising at least one of: (i) an electrical mechanism (ii) a magnetic field mechanism, (iii) a microwave mechanism, (iv) a high energy beam mechanism, and (v) a radio frequency mechanism.

12. The apparatus of claim 1, wherein the disintegrable accelerator material is selected to only decompose chemically and wherein the carrier body is selected to structurally destabilize by one of: (i) mechanically, (ii) thermally, and (iii) chemically.

13. A method for performing a downhole operation in a wellbore tubular, comprising:

conveying a debris catcher formed at least partially of a disintegrable accelerator material located in a carrier body;

filtering a downhole material using the debris catcher, the downhole material being in a subterranean fluid flowing through the wellbore tubular;

exposing the disintegrable accelerator material;

initiating a functionally intended chemical reaction between the disintegrable accelerator material and the downhole material; and degrading the downhole material received in the debris catcher.

14. The method of claim 13, further comprising releasing the disintegrable accelerator material including at least one of: (i) mechanically breaking the carrier body, (ii) chemically dissolving the carrier body, and (iii) electrically igniting an energetic material located in the carrier body, and (iv) thermally igniting an energetic material located in the carrier body.

15. The method of claim 13, further comprising sending a trigger into the wellbore tubular and activating an energetic material located in the carrier body.

16. The method of claim 13, further comprising sending a trigger into the wellbore and activating a trigger member located in the debris catcher.

17. The method of claim 13, wherein the disintegrable accelerator material interacts only chemically with the downhole material in the debris catcher, and further comprising: structurally destabilizing the carrier body by one of: (i) mechanically, (ii) thermally, and (iii) chemically.

* * * * *